US006442789B1

(12) United States Patent
Legatt et al.

(10) Patent No.: US 6,442,789 B1
(45) Date of Patent: Sep. 3, 2002

(54) RIDING FLOOR SCRUBBER

(75) Inventors: Donald J. Legatt, St. Michael; Paul T. Mueller, Bloomington; Wolfgang C. Lehmann, Maple Grove, all of MN (US)

(73) Assignee: Nilfisk-Advance, Inc., Plymouth, MN (US)

( * ) Notice: Subject to any disclaimer, the term of this patent is extended or adjusted under 35 U.S.C. 154(b) by 0 days.

(21) Appl. No.: 10/034,475

(22) Filed: Dec. 28, 2001

Related U.S. Application Data

(63) Continuation-in-part of application No. PCT/US00/18238, filed on Jun. 30, 2000, which is a continuation-in-part of application No. 09/340,486, filed on Jun. 30, 1999, now abandoned.

(51) Int. Cl.[7] ..... A47L 11/30
(52) U.S. Cl. ..... 15/320; 15/340.3; 15/353
(58) Field of Search ..... 15/320, 340.1, 15/340.3, 353

(56) References Cited

U.S. PATENT DOCUMENTS

| | | | | |
|---|---|---|---|---|
| 3,065,490 | A | 11/1962 | Arones | |
| 3,461,479 | A | 8/1969 | Tierney | |
| 3,879,789 | A | 4/1975 | Kasper | 15/320 |
| 4,006,506 | A | 2/1977 | Burgoon | 15/320 |
| 4,041,567 | A | 8/1977 | Burgoon | |
| 4,107,813 | A | 8/1978 | Torres | |

(List continued on next page.)

FOREIGN PATENT DOCUMENTS

| | | |
|---|---|---|
| DE | 3816098 | 5/1988 |
| DE | 19748277 C1 | 6/1999 |
| EP | 0786229 A2 | 7/1997 |
| EP | 0786229 A3 | 5/1998 |
| GB | 2274977 A | 8/1994 |
| WO | 7900755 | 10/1979 |

OTHER PUBLICATIONS

Windsor Industries, Inc., Quick/Pivot Owner's Guide, Model QK32/QP32, Apr. 1, 1998, 78 pgs.
Advance Machine Company, Hydro–Retriever 5010B Parts List (Models 452100, 452105), 12/89, 30 pgs.
12 color photographs of a 74 centimeter width Comac floor scrubber.

*Primary Examiner*—Theresa T. Snider
(74) *Attorney, Agent, or Firm*—Alan Kamrath; Rider, Bennett, Egan & Arundel, LLP

(57) ABSTRACT

A riding floor scrubber (10) is disclosed having a relatively narrow cleaning width for passing through relatively narrow passages such as conventional doorways. The riding floor scrubber (10) includes a recovery tank (16) that is vertically and laterally arranged and removably attached to the back of a clean solution tank (14). The clean solution tank (14) includes spaced parallel side portions (26, 28) and the recovery tank (16) extends between the rear ends of the side portions (26, 28). The recovery tank (16) is secured by first and second brackets (42) that extend into recesses (44) on the clean solution tank (14), with the bottom of the recovery tank (16) including a lip portion (46) resting on a metal plate (20) of a chassis (18), with a battery pack (52) being supported on the plate (20) between the side portions (26, 28) of the clean solution tank (14). The clean solution tank (14) includes a middle portion (29) and a lower portion (24) integrally extending forwardly of the middle portion (29), with the left side portion (26) extending to the same longitudinal extent as the lower portion (24). The clean solution tank (14) is molded into a complex shape to maximize capacity, with the bottom of the clean solution tank (14) being recessed to receive the chassis (18) of a tricycle type to define triangular-shaped volumes (88).

22 Claims, 4 Drawing Sheets

U.S. PATENT DOCUMENTS 4,196,492 A 4/1980 Johnson et al.
4,293,971 A 10/1981 Block ..... 15/320
4,333,202 A 6/1982 Block
4,339,841 A 7/1982 Waldhauser et al.
4,369,540 A 1/1983 Burgoon et al.
4,483,041 A 11/1984 Waldhauser et al. ..... 15/320
4,586,208 A 5/1986 Trevarthen
4,819,676 A 4/1989 Blehert et al.
4,845,801 A 7/1989 Milly et al.
4,945,602 A 8/1990 Kohl et al.
4,986,378 A 1/1991 Kasper
5,093,955 A 3/1992 Blehert et al.
5,178,655 A 1/1993 Sassier
5,224,236 A 7/1993 Sallquist
5,331,713 A 7/1994 Tipton
5,369,838 A 12/1994 Wood et al.
5,377,382 A 1/1995 Bores et al. ..... 15/340.1
5,383,251 A 1/1995 Whitaker et al.
5,454,138 A 10/1995 Mondigo et al. ..... 15/354
5,455,985 A 10/1995 Hamline et al. ..... 15/401
5,465,456 A 11/1995 Fellhauer et al.
5,473,792 A 12/1995 Kent et al.
5,566,422 A 10/1996 Geyer
5,623,743 A 4/1997 Burgoon et al.
5,640,738 A 6/1997 Williams et al.
5,655,254 A 8/1997 Bores et al.
5,706,549 A 1/1998 Legatt et al.
5,829,095 A 11/1998 Legatt et al.
5,873,138 A 2/1999 Geyer et al.
5,890,258 A 4/1999 Lee
5,901,410 A 5/1999 Windmeisser
6,088,873 A 7/2000 Pacchini et al. ..... 15/320
6,212,731 B1 4/2001 Eckerlein et al. ..... 15/320

RIDING FLOOR SCRUBBER

CROSS REFERENCE

The present application is a continuation-in-part of International Appln. No. PCT/US00/18238 filed Jun. 30, 2000 which is a continuation-in-part of U.S. application Ser. No. 09/340,486 filed Jun. 30, 1999, now abandoned. International Publication Number WO 01/00079 published on Jan. 4, 2001 of International Appln. No. PCT/US00/18238 is hereby incorporated herein by reference.

BACKGROUND OF THE INVENTION

The present invention relates generally to equipment for the floor-care industry, particularly to automatic floor scrubbers, and specifically to automatic floor scrubbers including unique provisions for riding on the floor scrubber and having a narrow cleaning width that permits passing through doorways and other relatively narrow passages.

A common method of cleaning hard floors is with a scrubber/dryer. These machines consist of a clean solution tank with means to apply solution to the floor, an agitating means for cleaning the floor, a dirty solution tank, and a vacuum means to pick up the dirty solution from the floor after the agitation action. The tanks and other mechanisms are usually attached to some type of chassis, which also has provisions for the power source, wheels and motivation requirements. Scrubber/dryers can be either walk-behind units or ride-on units. The power source for mostly all the walk-behind units comes from a battery pack, while the power for ride-on units comes from a battery pack on the smaller machines or an internal combustion engine on the larger machines.

Walk-behind scrubber/dryers predated the ride-on machines in the market. The ride-on machines were developed after customers who had large applications—e.g., warehouses, etc.—recognized the benefits of having floors cleaned with solution rather than just swept. The physical size of the application demanded the added productivity of a ride-on unit. So, whereas the early walk-behind machines were of a narrower width—approximately 17" to 20"—and then wider width machines were developed—approximately 26" and 32"—the early ride-on machines were wide width machines, in the 50" to 60" range.

With the aging of the workforce, with many applications making aisle widths narrower to accommodate more usable space, and with increasing labor rates, there has, in the past five years or so, been a recognized need for ride-on machines of a narrower width. End-users who previously used walk-behind machines are now demanding the added productivity and efficiency of a ride-on unit, but in a package size that fits these smaller applications.

A number of ride-on machines have been developed to satisfy these needs. Certain of these machines include substantial metal chassis with front, rear and side channels to protect the tanks from damage in extreme environments, as many of the applications were more the likes of warehouses and factories rather than stores and supermarkets. However, a need has continued for a smaller ride-on machine, which can maximize its maneuverability for smaller, tighter applications. At the same time, it is important that the smaller ride-on machines have large tanks to be able to carry large amounts of solution, to avoid frequent stoppages for dumping and refilling.

The ride-on floor scrubber of the present invention overcomes difficulties described above and affords other features and advantages heretofore not available.

SUMMARY OF THE INVENTION

The riding floor scrubber of the present invention has, in its preferred embodiment, a relatively narrow 28" cleaning width. While minimizing the size of the ride-on floor scrubber, the volume of the clean solution tank is also maximized by forming the tank into a U-shape in the back under the seat, to continue to run one of the legs—preferably on the left side—to the front for the full length of the machine, and horizontally under the feet of the operator.

Further, the chassis is of the tricycle type with only a single front wheel so that the front of the chassis can be made V-shaped. This allows the solution tank to extend in first and second V-shaped areas on the opposite sides of the chassis for the full thickness of the chassis. This results in a substantial increase in the tank volume.

It is therefore an object of this invention to provide a riding floor scrubbing machine having common functionalities and operational mechanisms, but which is small enough and maneuverable enough to pass through narrower passageways, such as grocery store aisles and conventional doorways. It is a further object of this invention to provide a riding floor scrubbing machine that is sturdy, having a strong, metal chassis, and that provides sufficient protection to fluid storage tanks, even in extreme environments.

It is also an object of the present invention to provide a smaller ride-on machine having large tanks to be able to carry large amounts of solution, thus avoiding frequent stoppages for dumping and refilling.

It is a further object of the present invention to position the batteries that power the ride-on floor cleaner so that they are accessible for maintenances purposes and replacement, and that the batteries are positioned relative to the wheels and the center of gravity of the machine to provide a stable operating condition, and consistent weights on each wheel.

It is yet a further object of the present invention to position the recovery tank so that contaminants may be thoroughly cleaned and flushed out of the tank to prevent bacteria and odors from developing. Thus the recovery tank is intended to be as accessible and easy to clean as possible.

Other objects and advantages of the invention will become apparent from the following detailed description of an illustrative embodiment of this invention is described in connection with the drawings.

BRIEF DESCRIPTION OF THE DRAWINGS

The illustrative embodiment may best be described by reference to the accompanying drawings where.

Figure 1:
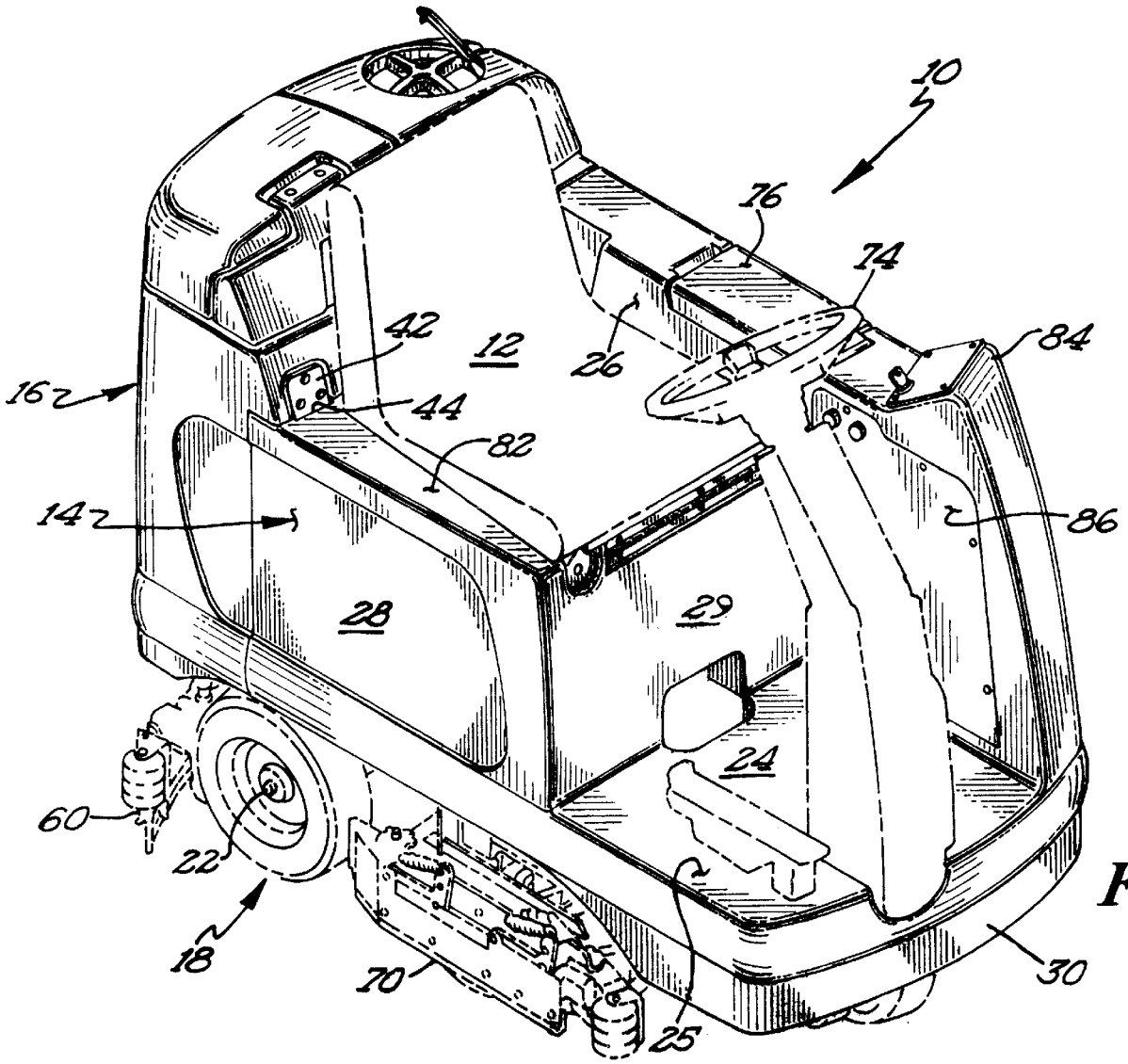
FIG. 1 is a perspective view of a riding floor scrubber according to the preferred teachings of the present invention.
Figure 2:
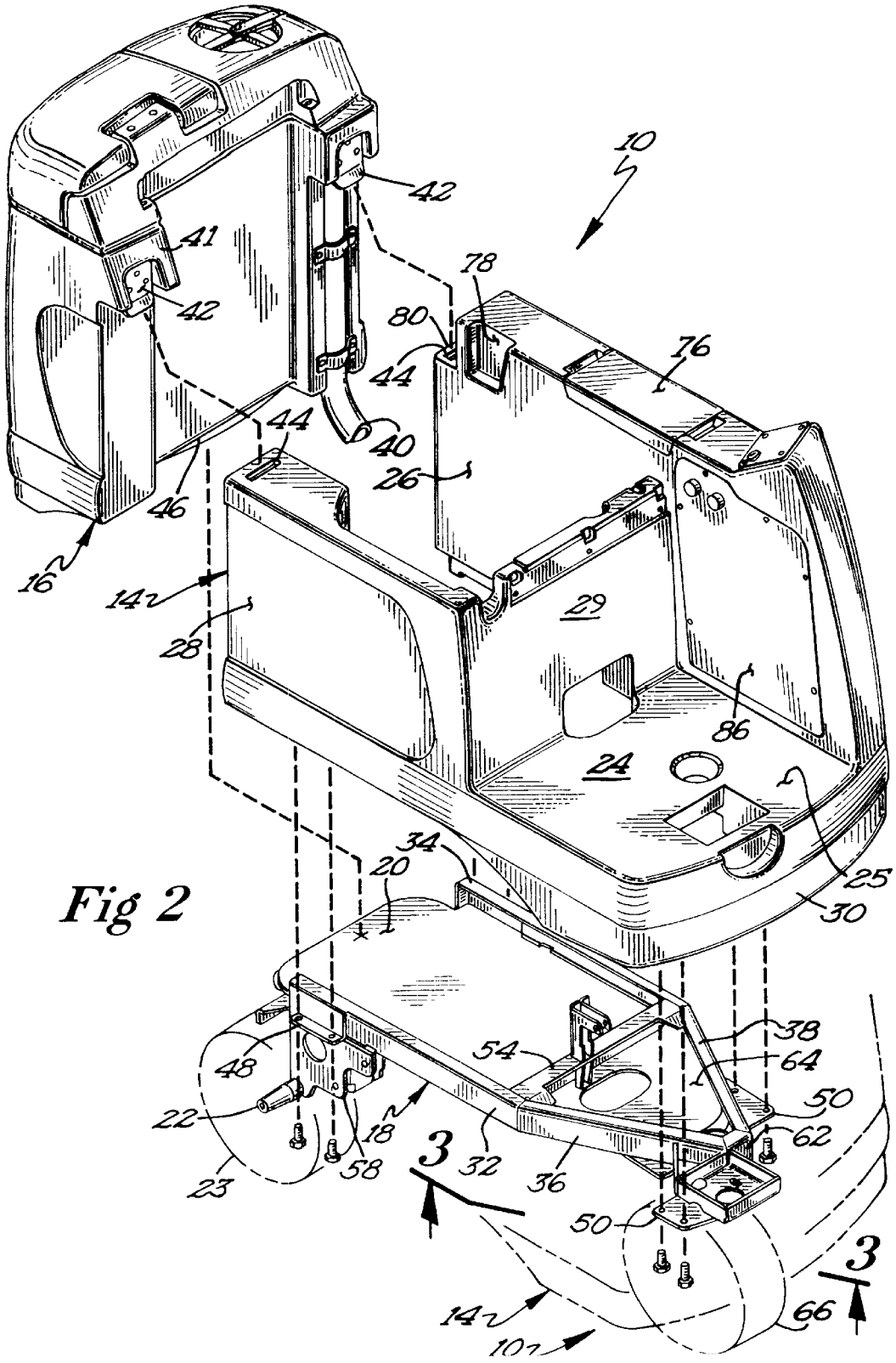
FIG. 2 is an exploded perspective view showing the main components thereof.
Figure 3:
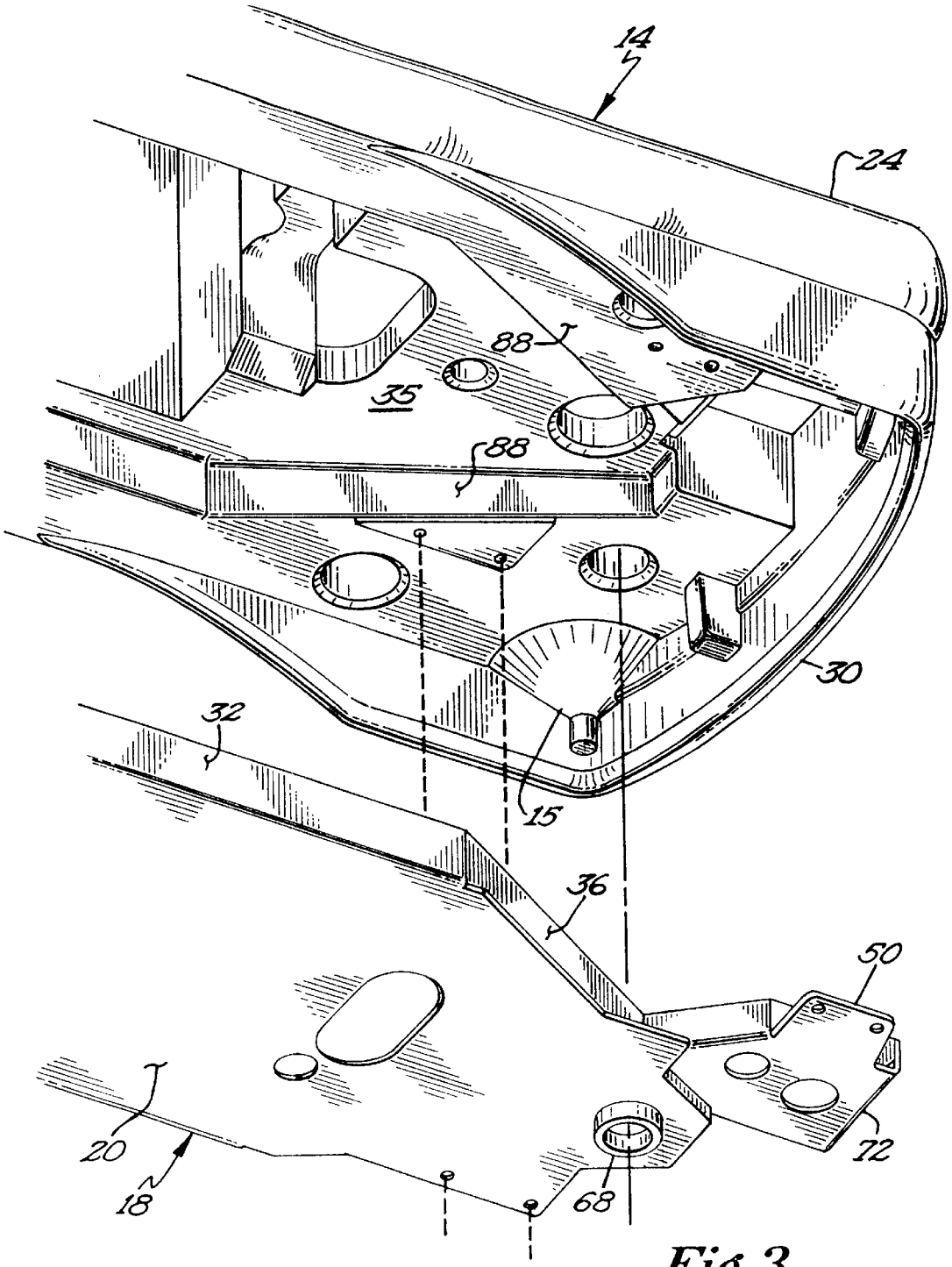
FIG. 3 is a section view taken along line 3—3 of FIG. 2.
Figure 4:
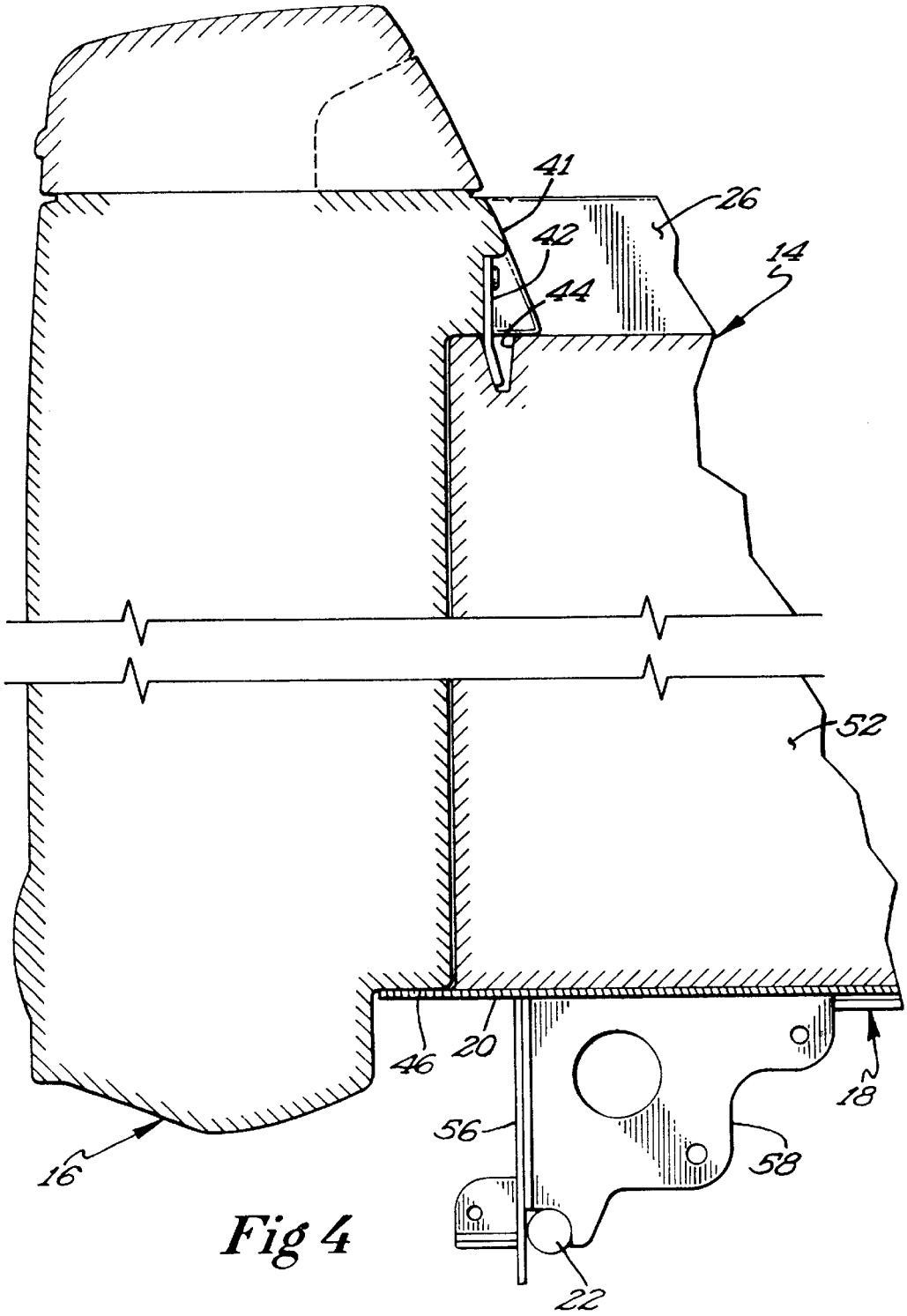
FIG. 4 is a diagramatic partial side section view of the recovery tank showing the upper and lower attachment points thereof.

All figures are drawn for ease of explanation of the basic teachings of the present invention only; the extensions of the figures with respect to number, position, relationship and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top," "bottom," "right," "left," "forward," "rear," "first," "second," "inside," "outside," and similar terms are used herein, it should be understood that these terms have reference only to the structure shown in the drawings as it would appear to a person viewing the drawings and are utilized only to facilitate describing the illustrative embodiment.

DETAILED DESCRIPTION OF PREFERRED EMBODIMENTS

A floor surface cleaning machine according to the preferred teachings of the present invention is shown in the drawings in the preferred form of a floor scrubber and generally designated 10. In the most preferred form, scrubber 10 is of the ride-on type. Generally, scrubber 10 includes a seat 12 for a machine operator, a clean solution tank 14, a recovery tank 16, and a chassis 18 moveably supported on the floor surface.

Chassis 18 generally includes a rectangular chassis plate 20 spaced from and generally parallel to the floor surface and adapted to receive a battery pack 52 which can be made up of various batteries connected together to provide the appropriate power requirements and typically provided within a battery tray. Each of the batteries in the battery pack 52 can weigh up to 125 pounds. Chassis plate 20 is supported by a frame including right and left vertical side rails 32 and 34 extending generally parallel to each other and attached to the upper surface of plate 20. A lateral, vertical rail 54 extends generally perpendicularly between the front ends of rails 32 and 34 and across the upper surface of plate 20. A lateral, vertical plate 56 extends generally perpendicularly between the back ends of rails 32 and 34, beneath plate 20, and forward of the back or rear edge of plate 20. Right and left triangular shaped axle mounts 58 extend between plate 56 and rails 32 and 34 and mount a laterally extending rear axle 22 for rotatably mounting wheels 23 on the opposite ends thereof. Plate 20 includes mounting flanges 48 extending laterally outwardly from the lower edges of rails 32 and 34 adjacent the rear ends thereof.

In the most preferred form, scrubber 10 includes a squeegee assembly 60 mounted to chassis 18 for purposes of wiping the floor surface and collecting the dirty solution for vacuum pickup. Squeegee assembly 60 can be of any conventional design and includes suitable provisions for floating on the floor surface during an operation mode as well as being raised from the floor surface during a transport mode.

Chassis 18 in the most preferred form is of the tricycle type and generally includes right and left vertical rail portions 36 and 38 extending at an acute angle inwardly from the forward ends of rails 32 and 34, respectively. The front ends of rail portions 36 and 38 terminate in a front rail portion 62 extending generally parallel to lateral rail 54. Plate 20 includes an extension 64 generally extending below portions 36, 38 and 62, and includes mounting flanges 50 extending laterally beyond portions 36 and 38 adjacent portion 62.

In the most preferred form, scrubber 10 includes a single, steerable drive wheel 66 mounted to chassis 18 such as by suitable provisions 68 provided in extension 64 adjacent to rail portion 62. In the most preferred form, wheel 66 is a purchased component of conventional design and includes a battery powered motor for purposes of driving scrubber 10. Further, scrubber 10 includes a suitable scrubbing member 70 mounted to chassis 18 for purposes of agitating the floor surface. Scrubbing member 70 can be of any conventional design and includes suitable provisions for floating on the floor surface during an operation mode as well as being raised from the floor surface during a transport mode.

Chassis 18 in the most preferred form includes a steering assembly mount 72 extending forwardly from the front rail portion 62 and in the most preferred form is offset laterally to the right from the center line defined by provisions 68 for mounting drive wheel 66. A suitable steering assembly 74 is mounted to assembly mount 72 for purposes for rotating drive wheel 66 in provisions 68 and thereby steering drive wheel 66. Steering assembly 74 can be of any conventional design and can have the ability to tilt away from seat 12 for ease of operator entry and exit.

According to the preferred teachings of the present invention, clean solution tank 14 is integrally formed of plastic by roto-molding and generally includes first and second, vertical, longitudinally extending side portions 26 and 28 in a spaced parallel relation extending on opposite sides of chassis plate 20 and having rear ends adjacent to the rear edge of the chassis plate 20. In the most preferred form, side portion 28 (located on the right side of scrubber 10 when the operator is on seat 12) includes an expansion extending longitudinally beyond rail 32 such that side portion 26 has a longitudinal length generally corresponding to rail 32 whereas side portion 26 (located on the left side of scrubber 10 when the operator is on the seat 12) has a longitudinal length generally corresponding to chassis 18. Tank 14 further includes a laterally extending, vertical middle portion 29 extending generally perpendicularly between the forward end of side portion 28 and side portion 26 spaced from the rear ends and particularly intermediate its forward and rear ends of side portion 26. In the most preferred form, portion 29 generally corresponds to and overlays rail 54 and in the most preferred form includes a cut-out portion for receipt of and access to the drive motor and other components of scrubbing member 70. In the most preferred form, the upper surfaces of portions 28 and 29 have an equal height. In the most preferred form, side portion 26 has a vertical height slightly greater than the height of side portion 28 and includes provisions 76 for adding solution to tank 14 which is shown as including a hinged cover. Side portion 26 includes an inwardly facing recess 78 adjacent the rear end and extending from the upper surface thereof defining a shoulder at a height generally corresponding to the height of side portion 28. The upper, rear corner of side portion 26 is stepped and includes a horizontal upper surface or ledge 80 at a height generally corresponding to the height of the upper surface of side portion 28.

In the most preferred form, seat 12 is mounted to a plate 82 which is hingedly mounted to middle portion 29. In its normal position, plate 82 abuts with the upper surface of side portion 28 and includes an ear which is not shown that extends into and is supported upon the shoulder of the recess 78. Plate 82 and seat 12 can be pivoted relative to middle portion 29 until seat 12 engages with steering assembly 74.

According to the preferred teachings of the present invention, clean solution tank 14 further includes a horizontal, lower portion 24 extending spaced from and generally parallel to the floor surface. Lower portion 24 integrally extends longitudinally forward from the lower end of middle portion 29 to a longitudinal extent generally equal to side portion 26. Lower portion 24 also integrally extends from the lower end of side portion 26 and has an outer lateral extent generally equal to the outer lateral extent of side portion 28. Clean solution tank 14 further includes a depending skirt portion 30 of a generally U-shape having a central member extending along the front of portion 24 and having first and second leg members extending along the outer edges of portion 24 (and portion 26) at a longitudinal extent towards but not to the extent of lateral rail 54.

In the most preferred form, the upper front corner of portion 26 includes an angled portion 84 which includes a recessed portion for receipt of electrical components such as but not limited to electrical switches, gauges and the like for scrubber 10. Additionally, the inside wall of side portion 26 in front of middle portion 29 includes a recessed portion 86 covered by a removable panel for holding other operational components including but not limited to the electronic controls of scrubber 10. These recessed portions are advantages in providing an unobstructed operator stand for both aesthetic and functional reasons.

In the most preferred form, the upper wall 25 of lower portion 24 which extends generally parallel to the floor surface and upon which the operator's feet can be supported is planar and specifically is generally free of obstruction from middle portion 29 to a front edge of lower portion 25 and from the expansion of side portion 26 to an opposite side edge. Thus, the operator sitting upon seat 12 has a relatively unobstructed view in the forward direction and is able to see the right forward corner of tank 14 and of scrubber 10 for purposes of maneuvering scrubber 10 adjacent to walls and other obstructions in operation of scrubber 10 according to the teachings of the present invention.

In the most preferred form, clean solution tank 14 has a lateral extent greater than chassis 18 and in the most preferred form to an extent generally equal to the outer extent of wheels 23 on axle 22 and of scrubbing member 70. The bottom of clean solution tank 14 includes a recessed portion 35 for receipt of chassis 18. In particular, recessed portion 35 includes a first portion formed in the bottom of lower portion 24 and of middle portion 29 of a shape corresponding to and for receipt of rail portions 36 and 38, lateral rail 54 and plate extension 64. Recessed portion 35 further includes second and third portions formed in the bottom of side portions 26 and 28 for receipt of rails 32 and 34. Thus, the bottom of clean solution tank 14 has a lower extent generally equal to the lower extent of plate 20 and extension 64 and extends around and outside of chassis 18. Thus, the bottom of clean solution tank 14 includes first and second volumes 88 having generally triangular shapes in horizontal cross section having inside walls generally corresponding to portions 36 and 38 and bottom walls at a vertical height corresponding to plate extension 64 and the lower edges of portions 36 and 38. It should then be appreciated that due to the tricycle shape of chassis 18 and recessed portion 35 of clean solution tank 14 resulting in volumes 88, the capacity of solution tank 14 and thus the amount of clean solution which can be held therein is maximized. In the most preferred form, volumes 88 represent an increase of approximately 20% of the capacity of clean solution tank 14 which represents a significant operation advantage for scrubber 10.

In the most preferred form, recovery tank 16 is removeably mounted to and carried by chassis 18 and clean solution tank 14 and in the most preferred form is vertically and laterally arranged. Specifically, tank 16 is removeably attached to tank 14 and extends between the rear ends of side portions 26 and 28 of tank 14 in the preferred form. Particularly, in the most preferred form, recovery tank 16 includes forwardly extending first and second projections 41 having lower edges adapted to abut with ledge 80 of side portion 26 and the upper wall of side portion 28. Projections or brackets 42 are suitably separately or integrally formed in pockets in projections 41 and which can be removeably inserted into corresponding recesses 44 of ledge 80 and the upper wall of side portion 28. The bottom of recovery tank 16 includes a lower lip portion 46 for abutting with and being supported on plate 20 adjacent its rear edge.

It should then be appreciated that recovery tank 16 is supported at three locations, specifically at the abutment of lip portion 46 with plate 20 and the abutment of projection 41 with side portions 26 and 28, with the majority of the weight being carried by abutment of lip portion 46 with plate 20 and thus being carried directly by chassis 18 rather than through clean solution tank 14. Thus, clean solution tank 14 is not subject to fatigue from carrying recovery tank 16. The major function of brackets 42 inserted in recesses 44 is to keep recovery tank 16 in a vertical orientation and specifically to keep recovery tank 16 from tipping on plate 20 away from clean solution tank 14 and from moving laterally relative to tank 14. Brackets 42 are not intended to engage recess 44 in a manner to support tank 16. The three location support of recovery tank 16 is also advantageous in reducing fatigue stresses placed on tank 16.

In the most preferred form, recovery tank 16 includes a vacuum assembly such as of the type shown and described in U.S. Pat. No. 5,829,095, which is hereby incorporated herein by reference, but in an inverted arrangement for purposes of drawing air from the interior of recovery tank 16. An inlet hose 40 in fluid communication with the squeegee assembly 60 extends from recovery tank 16 for flow of cleaning solution recovered from the floor surface by squeegee assembly 60.

It should then be appreciated that the arrangement of recovery tank 16 and clean solution tank 14 according to the teachings of the present invention is advantageous. Specifically, recovery tank 16 can be removed from scrubber 10 (after removal of any electrical connection to the vacuum assembly provided and disconnection of hose 40) by simply lifting recovery tank 16 to raise brackets 42 from recesses 44. This is advantageous as once removed, recovery tank 16 can be tilted or canted to swivel solution therein for removing sediment that may have built up in the bottom of tank 16.

Further, with recovery tank 16 removed according to the preferred teachings of the present invention, rear access is available to battery pack 52 supported upon chassis plate 20. Thus, battery pack 52 can be easily slid into and out of the battery compartment defined by plate 20, side portions 26 and 28 and middle portion 29. Additionally, for increased accessibility. plate 82 and seat 12 can be pivoted to provide vertical access to battery pack 52. In particular, it is not necessary to raise battery pack 52 in a vertical direction for removal. Removal of battery pack 52 is necessary for servicing and may be desirable to allow recharging of the batteries while scrubber 10 is being operated on a fresh battery pack 52. Further, battery pack 52 is supported upon plate 20 formed of metal and is not supported in any way by tanks 14 and 16. It, of course, should be realized that access is available to battery pack 52 with tank 16 attached to scrubber 10 by pivoting plate 82 and seat 12 according to the teachings of the present invention whether or not recovery tank 16 is removed.

Scrubber 10 according to the preferred teachings of the present invention is especially advantageous for applications having a relatively small cleaning width while having the operator being supported in a sitting position. Specifically, scrubber 10 in the most preferred form has a total width that is able to pass through conventional doorways without requiring disassembly and is able to maneuver in smaller, tighter applications. In particular, the particular shape and relationships of tanks 14 and 16 with each other and with battery pack 52 is advantageous in reducing the overall size of scrubber 10 to a minimum to fit through conventional doorways but to maximize the volume of tanks 14 and 16 so that refilling is not necessary for a typical battery run with scrubber 10. The intended application of scrubber 10 according to the preferred teachings of the present invention should be acceptable even if tanks 14 and 16 are more exposed to the environment.

Clean solution tank 14 includes a solution discharge port 15 to allow controlled gravitational release of solution from tank 14 to the floor surface at or in front of scrubbing member 70 in any conventional manner. It can then be appreciated that clean solution does not have the contaminants which can develop between growth and odors as does solution recovered from the floor surface, and that it is not necessary for clean solution tank 14 to be cleaned and flushed out as does recovery tank 16. Thus, clean solution tank 14, according to the teachings of the present invention, can be molded in a complex shape or form to maximize strength and to best utilize spaces in scrubber 10 to maximize solution volume. This is especially advantageous for scrubbers 10 having a relatively narrow cleaning width as the space required for tank 14 containing clean solution is one of the important factors in determining the physical size of scrubber 10. In this regard, clean solution tank 14 can be fabricated in a manner creating pockets which hold solution but which is unable to be drained, but with the pockets being necessary in the fabrication of tank 14 for strength reasons.

Those skilled in the art will further appreciate that the present invention may be embodied in other specific forms without departing from the spirit or central attributes thereof. In that the foregoing description of the present invention discloses only exemplary embodiments thereof, it is to be understood that other variations are contemplated as being within the scope of the present invention. Accordingly, the present invention is not limited in the particular embodiments which have been described in detail therein. Rather, reference should be made to the appended claims as indicative of the scope and content of the present invention.

What is claimed is:

1. A machine for cleaning floor surfaces comprising, in combination:

a chassis movably supported on the floor surface, with the chassis including a chassis plate spaced from and generally parallel to the floor surface and having left and right sides and a rear edge;

a scrubbing member mounted to the chassis for agitating the floor surface;

a first solution tank carried by the chassis and including left and right side portions extending on opposite sides of the chassis plate adjacent to the left and right sides and having rear ends adjacent to the rear edge of the chassis plate; and a second solution tank carried by the chassis and removably attached to the first solution tank and extending between the rear ends of the left and right side portions of the first solution tank.

2. The machine of claim 1 wherein the left and right side portions include upper surfaces;

and wherein the second solution tank includes first and second projections which abut with the upper surfaces of the left and right side portions of the first solution tank.

3. The machine of claim 2 wherein one of the projections and the upper surfaces includes recesses and the other of the projections and the upper surfaces includes brackets slideably received in the recesses.

4. The machine of claim 3 wherein the second solution tank includes a lip portion which rests upon the chassis plate adjacent to the rear edge of the chassis plate.

5. The machine of claim 4 wherein the first solution tank further includes a middle portion extending between the left and right side portions and spaced from the rear ends, with the middle portion including an upper surface; and wherein the machine includes an operator seat supported on the left and right side portions and the middle portion of the first solution tank.

6. The machine of claim 5 wherein one of the left and right side portions includes an expansion extending longitudinally past the middle portion and the other of the left and right side portions terminates in the middle portion.

7. The machine of claim 6 wherein the first solution tank further includes a lower portion extending from the middle portion generally parallel to the floor surface, and wherein the chassis is of a tricycle type and includes right and left rail portions extending at an acute angle inwardly from the left and right sides of the chassis plate; and wherein the first solution tank includes a bottom having a recessed portion formed therein which receives the chassis defining first and second volumes having generally triangular shapes in cross sections parallel to the floor surface and having inside walls generally corresponding to the right and left rail portions.

8. The machine of claim 7 wherein the lower portion extends from the expansion.

9. The machine of claim 7 wherein the lower portion includes an upper wall generally parallel to the floor surface and being generally free of obstruction from the middle portion to a front edge and from the expansion to an opposite side edge.

10. The machine of claim 6 wherein the expansion includes recesses for receipt of electrical components.

11. The machine of claim 1 further comprising, in combination:

at least a first recess formed in one of the left and right side portions for receipt of components.

12. The machine of claim 1 further comprising, in combination:

a battery pack for providing power to the machine and supported on the chassis plate between the left and right side portions and in front of the second solution tank.

13. The machine of claim 12 further comprising, in combination:

a squeegee assembly mounted to the chassis for purposes of wiping the floor surface and collecting dirty solution for vacuum pickup.

14. The machine of claim 1 wherein the first solution tank further includes a middle portion extending between the left and right side portions and spaced from the rear ends, with the middle portion including an upper surface; and wherein the machine includes an operator seat supported on the left and right side portions and the middle portion of the first solution tank.

15. The machine of claim 1 wherein the chassis is of a tricycle type and includes right and left rail portions extending at an acute angle inwardly from the left and right sides of the chassis plate; and wherein the first solution tank includes a bottom extending generally parallel to the floor surface and having a recessed portion formed therein which receives the chassis and defining first and second volumes having generally triangular shapes in cross sections parallel to the floor surface and having inside walls generally corresponding to the right and left rail portions.

16. A machine for cleaning a floor surface comprising, in combination:

a chassis movably supported on the floor surface, with the chassis being of a tricycle type and including right and left rail portions extending inwardly at an acute angle;

a scrubbing member mounted to the chassis for agitating the floor surface; and a first solution tank carried by the chassis and including a bottom extending generally parallel to the floor surface and having a recessed portion formed therein which receives the chassis and defining first and second volumes having generally triangular shapes in cross sections parallel to the floor surface and having inside walls generally corresponding to the right and left rail portions.

17. The machine of claim 16 wherein the first solution tank includes an upper wall generally parallel to the floor surface and being generally free of obstruction upon which an operator's feet can be supported.

18. The machine of claim 16 wherein the chassis further includes a chassis plate spaced from and generally parallel to the floor surface and having left and right sides, with the right and left rail portions extending from the left and right sides of the chassis plate, with the recessed portion receiving the left and right sides of the chassis plate and with the first solution tank extending outside of the left and right sides of the chassis plate.

19. The machine of claim 18 wherein the first solution tank further includes right and left edges, a front and a depending skirt portion of a generally U-shape and having a central member extending along the front and first and second leg members extending from the central member and along the right and left edges.

20. The machine of claim 18 further comprising, in combination:

a second solution tank carried by the chassis and attached to the first solution tank.

21. The machine of claim 20 wherein the second solution tank is removably attached to the first solution tank and is carried directly by the chassis rather than through the first solution tank.

22. The machine of claim 16 wherein the first solution tank further includes a lower portion having the bottom and having an upper wall generally parallel to the floor surface upon which an operator's feet can be supported; and wherein the first solution tank further includes at least one vertical, longitudinally extending side portion having a lower end, with the lower portion integrally extending from the lower end of the side portion.

* * * * *